US008113489B1

(12) United States Patent
Harder

(10) Patent No.: US 8,113,489 B1
(45) Date of Patent: Feb. 14, 2012

(54) RAIL

(76) Inventor: Willard J. Harder, Farmington, MN (US)

( * ) Notice: Subject to any disclaimer, the term of this patent is extended or adjusted under 35 U.S.C. 154(b) by 407 days.

(21) Appl. No.: 12/322,879

(22) Filed: Feb. 9, 2009

Related U.S. Application Data

(60) Continuation-in-part of application No. 12/150,284, filed on Apr. 28, 2008, now Pat. No. 7,748,686, which is a division of application No. 11/056,566, filed on Feb. 14, 2005, now Pat. No. 7,438,282, which is a division of application No. 10/636,034, filed on Aug. 8, 2003, now Pat. No. 6,932,329.

(60) Provisional application No. 60/418,280, filed on Oct. 15, 2002.

(51) Int. Cl.
*E04H 17/14* (2006.01)

(52) U.S. Cl. ..... 256/67; 256/22

(58) Field of Classification Search ..... 256/1, 19, 256/22, 65.01, 67, 70; D25/122
See application file for complete search history.

(56) References Cited

U.S. PATENT DOCUMENTS

| | | | | |
|---|---|---|---|---|
| 1,772,159 | A | 8/1930 | Roth | |
| D98,067 | S * | 1/1936 | Hendrickson | D25/122 |
| 2,932,488 | A * | 4/1960 | Dotson Leighton G | 256/21 |
| D210,287 | S * | 2/1968 | Venema | D13/182 |
| 3,434,258 | A * | 3/1969 | Leurent Ghislain | 52/772 |
| 3,753,209 | A * | 8/1973 | Hesse | 439/117 |
| 3,858,850 | A * | 1/1975 | Maxcy et al. | 256/22 |
| D243,683 | S * | 3/1977 | Dallaire | D25/124 |
| D245,756 | S * | 9/1977 | McKee | D8/376 |
| 4,150,907 | A | 4/1979 | Thurnauer | |
| 4,217,018 | A * | 8/1980 | Yoshida et al. | 439/118 |
| 4,222,680 | A | 9/1980 | Browning | |
| D257,666 | S * | 12/1980 | McKee | D8/376 |
| D263,755 | S * | 4/1982 | Dallaire | D25/122 |
| D270,667 | S * | 9/1983 | Cascone et al. | D25/122 |
| 4,505,456 | A | 3/1985 | Zieg | |
| 4,645,598 | A | 2/1987 | Hannum | |
| D291,832 | S * | 9/1987 | Lundstrom | D25/122 |
| D292,614 | S * | 11/1987 | Nilsson | D25/122 |
| D301,065 | S * | 5/1989 | Dallaire et al. | D25/122 |
| 4,928,930 | A | 5/1990 | Chung | |
| 5,288,058 | A | 2/1994 | Russell | |
| 5,313,756 | A | 5/1994 | Ways et al. | |
| 5,404,682 | A | 4/1995 | West | |
| 5,641,236 | A | 6/1997 | Hornung et al. | |
| D382,651 | S * | 8/1997 | Colitto | D25/122 |
| D382,652 | S * | 8/1997 | Colitto | D25/122 |
| D382,653 | S * | 8/1997 | Colitto | D25/122 |
| D386,330 | S * | 11/1997 | Russell | D6/495 |
| D401,357 | S * | 11/1998 | Rinot et al. | D25/122 |
| D408,932 | S * | 4/1999 | Hart | D25/122 |
| D423,117 | S | 4/2000 | Chaney et al. | |
| D424,213 | S | 5/2000 | Chaney et al. | |
| 6,062,519 | A | 5/2000 | Baldassarre | |
| 6,145,814 | A | 11/2000 | Perrot | |
| 6,568,658 | B2 | 5/2003 | Strome | |
| 6,932,329 | B1 * | 8/2005 | Harder | 256/67 |
| D541,953 | S | 5/2007 | Deleu | |
| D547,462 | S * | 7/2007 | Petta et al. | D25/122 |
| 2002/0062606 | A1 | 5/2002 | Hystad | |
| 2002/0134977 | A1 | 9/2002 | Bryan et al. | |

* cited by examiner

*Primary Examiner* — Victor MacArthur
(74) *Attorney, Agent, or Firm* — Richard John Bartz

(57) ABSTRACT

A railing system for decks and stairs has identical top and bottom metal extruded rails with upright spindles extended between the rails. Anchor balls secured to the rails with fasteners hold the spindles in assembled relation with the rails. The anchor balls have continuous circumferential ribs located in a force fit relationship with inside surfaces of the spindles.

17 Claims, 5 Drawing Sheets

RAIL

RELATED APPLICATIONS

This application is a continuation-in-part of Ser. No. 12/150,284 filed Apr. 28, 2008, now U.S. Pat. No. 7,748,686. Application Ser. No. 12/150,284 is a division of U.S. application Ser. No. 11/056,566 filed Feb. 14, 2005, now U.S. Pat. No. 7,438,282. Application Ser. No. 11/056,566 is a division of application Ser. No. 10/636,034 filed Aug. 8, 2003, now U.S. Pat. No. 6,932,329. Application Ser. No. 10/636,034 claims the priority date of U.S. Provisional Patent Application Ser. No. 60/418,280 filed Oct. 15, 2002.

FIELD OF THE INVENTION

The invention is the art of rails for deck railings, fences and barriers used to separate environmental areas. The particular field of the invention relates to residential and commercial rails and railings having upright laterally spaced balusters or spindles attached to rails.

BACKGROUND OF THE INVENTION

Residential decks and stairs have railings to separate these structures from adjacent areas and prevent persons from falling off the decks and stairs. The railings have top rails support on upright posts attached to the decks and stairs. A number of laterally spaced upright members, known as balusters, spindles or pickets, extend between the top rails and decks and stairs. Wood upright members are fastened to the rails with nails, screws and adhesives. Dowel-type joints are also used to connect opposite ends of wood upright members to top and bottom rails. Metal railings have upper and lower rails and upright metal members extended between and welded to the rails. Fasteners, such as screws, are used to connect top and bottom metal rails to opposite ends of the upright metal members. Railings for stairs have upright members with at least one angled end or angled opposite ends. Each angled end must be secured to an inclined stair railing. A substantial amount of time, labor and craftsmanship is employed to assemble and construct deck and stair railings.

Wood rails for decks and stairs are treated with chemical preservatives containing copper containing materials to inhibit wood decay. Holes in the top and bottom rails accommodating opposite ends of aluminum or aluminum alloy spindles attach the spindles to the rails. Over time, copper corrodes aluminum causing the spindles to break away from the rails. Inserts are used to insulate the ends of the spindles from the treated wood rails to inhibit corrosion of aluminum spindles.

Examples of railing and baluster structures are disclosed in the following U.S. Patents.

M. Roth in U.S. Pat. No. 1,772,159 discloses a rail connection including a cylindrical block having a threaded hole accommodating a screw fastened to a rail. The block has opposite ends with conical recesses. A tubular member located over the block has center punches portions extended into the recesses to allow the tubular member to swing around the axis of the block.

S. A. Zieg in U.S. Pat. No. 4,505,456 discloses upright balusters extended between inclined top and bottom rails. Pivots on opposite ends of the balusters fit in sockets in the rails to connect the balusters to the rails. The pivots have parallel opposite sides and convex shaped opposite ends that allow angular movement of the balusters in only one vertical plane.

Y. K. Chung in U.S. Pat. No. 4,928,930 discloses a railing having top and bottom rails having rectangular grooves accommodating U-shaped plug members. Balusters have rounded opposite ends that fit in the U-shaped plug members. Fasteners, such as bolts, extended through slots in the plug members, secure the plug members to the opposite ends of the balusters. The angle between the top rail and each of the balusters is adjusted to move the top rail relative to the bottom rail to locate the top and bottom rails to be substantially parallel with a staircase to which the railing is mounted.

P. Perrot in U.S. Pat. No. 6,145,814 discloses a device for mounting a handrail on a post. The device includes ball elements mounted on the upper ends of posts. The ball elements located in recesses in the handrails are retained in the recesses with a cover secured to the bottoms of the handrails.

G. F. Strome in U.S. Pat. No. 6,568,658 discloses a railing having cylindrical shank connectors secured to rails or supports for connecting opposite ends of tubular members to rails. The connectors have circumferential external grooves accommodating O-rings. The tubular members telescope over the connectors and compress the O-rings to lock the tubular members on the connectors. The shank connectors do not allow angular adjustment of the tubular members relative to a rail.

E. J. A. Gierzak in U.S. Patent Application Publication U.S. 2002/0134977 discloses a hand rail assembly having upper and lower channel members extended between upright posts. Connectors secured to the channel members accommodate opposite ends of upright square tubular spindles. The connectors are square bosses with a series of ribs on the outer walls for a friction fit with the spindles and to prevent rotation of the spindles on the connectors. The connectors do not permit angular adjustment of the spindles relative to the rail.

SUMMARY OF THE INVENTION

The invention comprises a railing for a deck and stair having top and bottom rails connected to upright posts anchored to supports. Upright spindles extended between the top and bottom rails have opposite ends located in surface contact with the rails. Anchor balls or ball connectors support the spindles on the rails. Fasteners, such as deck screws, secure the anchor balls to the rails and maintain the knobs in firm engagement with the rails. The spindles are cylindrical metal tubes, such as coated aluminum tubes. The spindles can be square or multi-sided metal or plastic tubes. The opposite ends of the spindles are telescoped over the anchor balls to retain the spindles in fixed upright positions between the top and bottom rails. The anchor balls have hemispherical configurations with a size to accommodate the inside walls of the spindles with a tight annular friction or force fit. The opposite ends of the spindles have end surfaces located in surface engagement with the rails. The tight friction fit relation between the anchor balls and inside walls of the spindles provide annular seals to prevent moisture, water, dust, and dirt from entering the spaces with the spindles. The anchor balls have a plurality of outwardly directed continuous annular ribs which flex inwardly when the spindles are telescoped over the anchor balls. The ribs on each anchor ball are located in planes normal to the axis of the hole through the body of the anchor ball. The ribs are separate sealing rings located in a force fit biased relation with the inside walls of the spindles. The anchor balls allow the spindles to be moved to inclined positions relative to the rails without modifications or additional structures or welds. The anchor balls are pre-installed on the rails prior to assembly on the posts. This allows the railing to be constructed with a minimum of time and labor.

An alternate embodiment of the spindle comprises an elongated metal or plastic tube having an inside square wall with inwardly directed longitudinal projections or ribs. The projections are forced into the sides of the anchor balls when the spindles are pressed onto the anchor balls. The projections prevent the spindles from rotating relative to the anchor balls. The anchor balls are installed on the rails with a minimum of time and labor and with conventional tools. The ends of the spindles cover the anchor balls rendering the railing aesthetically pleasing and decorative.

The top and bottom rails are identical metal extrusions, such as aluminum extrusions, having upright side walls joined to top and bottom walls. The top wall and bottom wall have top and bottom surfaces. A longitudinal first groove extends longitudinally along the middle of the top surface of the top wall. The bottom surface of the top wall includes a pair of downwardly directed longitudinal first ribs laterally separated with a space that is vertically aligned with the groove in the top surface of the top wall. A longitudinal second groove extends longitudinally along the middle of the bottom surface of the bottom wall. The top surface of the bottom wall includes a pair of upwardly extended longitudinal second ribs laterally separated with a space that is vertically aligned with the groove in the bottom wall. A plurality of first anchor balls are secured to the top rail with fasteners guided by the groove in the bottom wall into the space between the second ribs and engageable with the second ribs thereby securing the first anchor balls to the top rail. A plurality of second anchor balls vertically aligned with the first anchor balls are secured with fasteners guided by the groove in the top wall of the bottom rail into the space between the first ribs and engageable with the first ribs to secure the second anchor balls to the top rail. Spindles are telescoped over the first and second anchor balls. Each anchor ball has a generally spherical body provided with an annular convex curved outside wall. A plurality of laterally spaced outwardly extended ribs or flanges on the outside wall cooperate with the inside walls of the spindles to provide annular friction fit seals that retain the spindles on the anchor balls. The fasteners extend through holes in the body to secure the anchor balls to the rails. The anchor balls are pre-assembled on the top and bottom rails. This saves time and labor in the construction of a railing.

DESCRIPTION OF THE INVENTION

Figure 1:
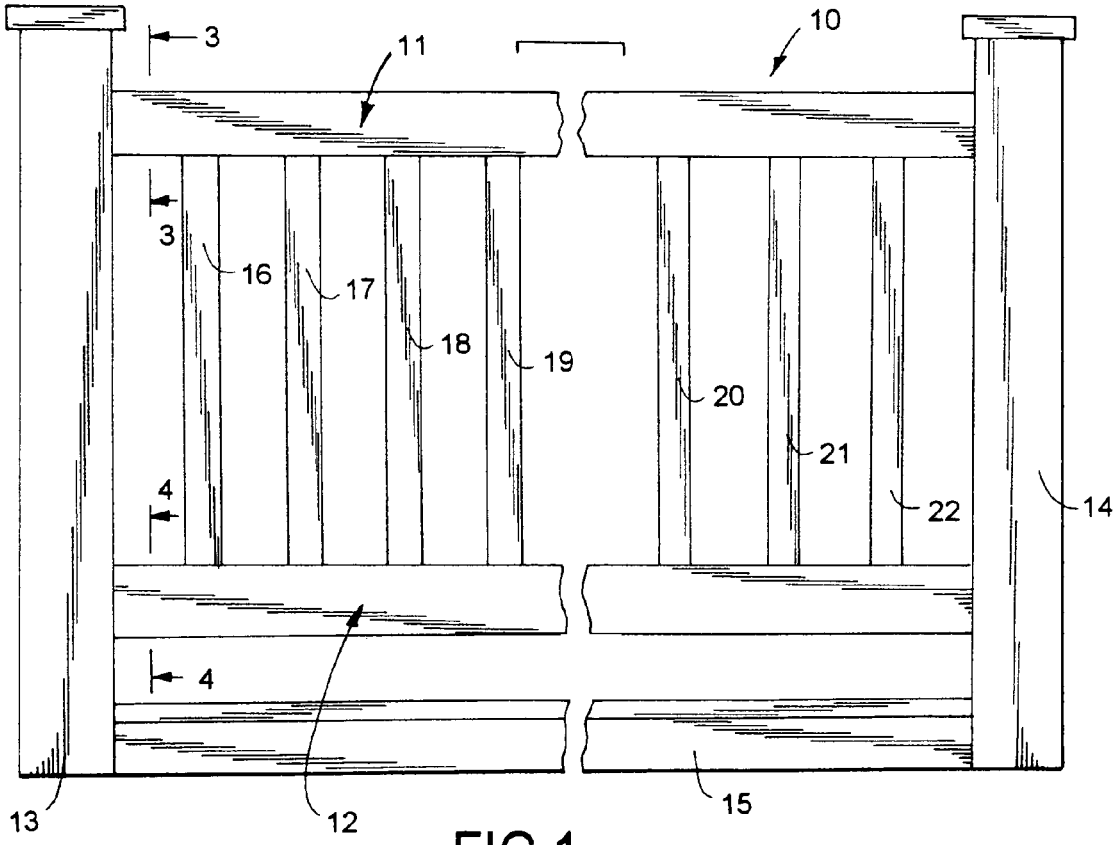
FIG. 1 is a front elevational view of a foreshortened section of the railing system of the invention.
Figure 2:
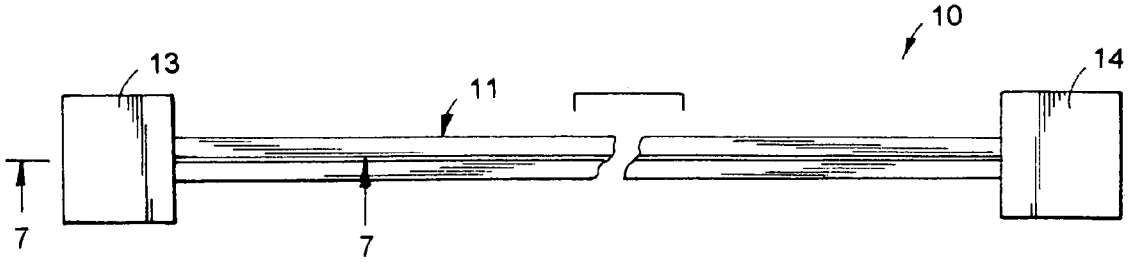
FIG. 2 is a top plan view of FIG. 1.

Railing system 10, shown in FIGS. 1 and 2, has horizontal top and bottom rails 11 and 12 secured to upright columns or posts 13 and 14. Posts 13 and 14 are square wood members secured to separate sections of a deck or platform 15. Other shapes and materials, including metal, ceramic, concrete, composite materials and plastic, can be used for posts 13 and 14. The bottom ends of posts 13 and 14 can be anchored in the ground. A plurality of upright spindles 16 to 22 extend between rails 11 and 12. Spindles 16 to 22 are cylindrical tubes, such as aluminum tubes. Adjacent spindles are laterally spaced from each other a distance according to building codes. Opposite ends of each spindle are anchored to rails 11 and 12 to maintain uniform spacing between adjacent spindles. Railing system 10, shown in FIG. 1, is a section of a railing structure having top and bottom rails secured to posts 13 and 14 and additional posts. The upright spindles extend between and are anchored to the top and bottom rails.

Figure 3:
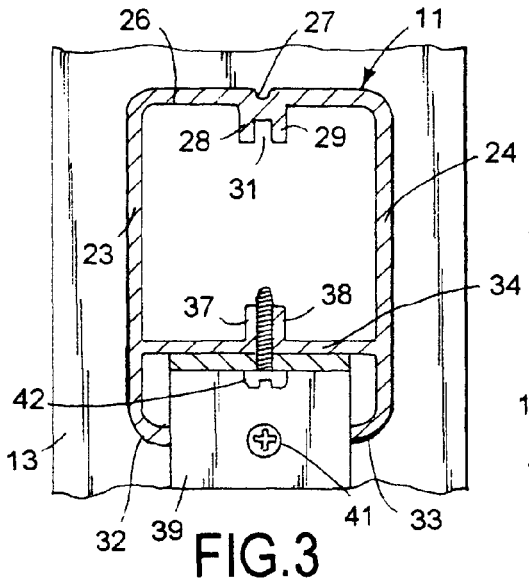
FIG. 3 is an enlarged sectional view taken along line 3-3 of FIG. 1.
Figure 4:
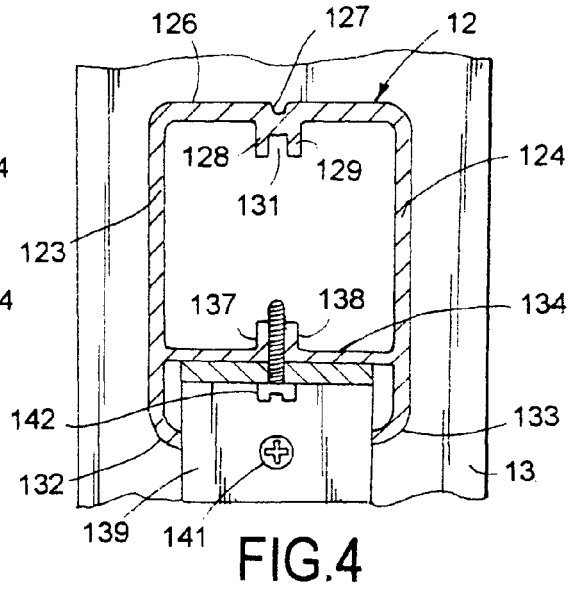
FIG. 4 is an enlarged sectional view taken along line 4-4 of FIG. 1.
Figure 5:
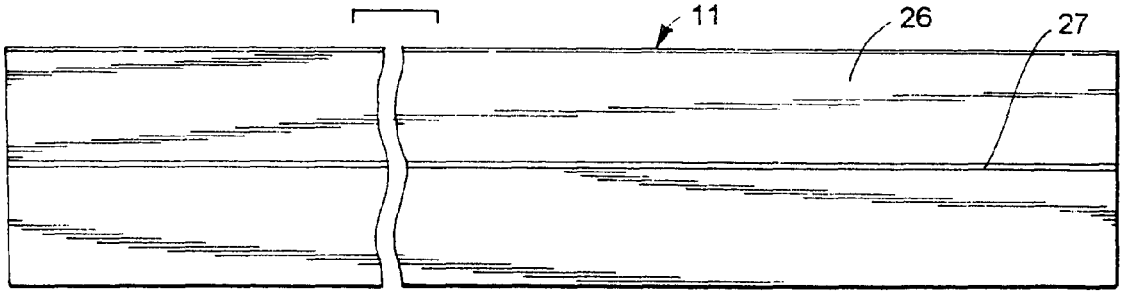
FIG. 5 is an enlarged foreshortened top plan view of the top rail of FIG. 1.
Figure 6:
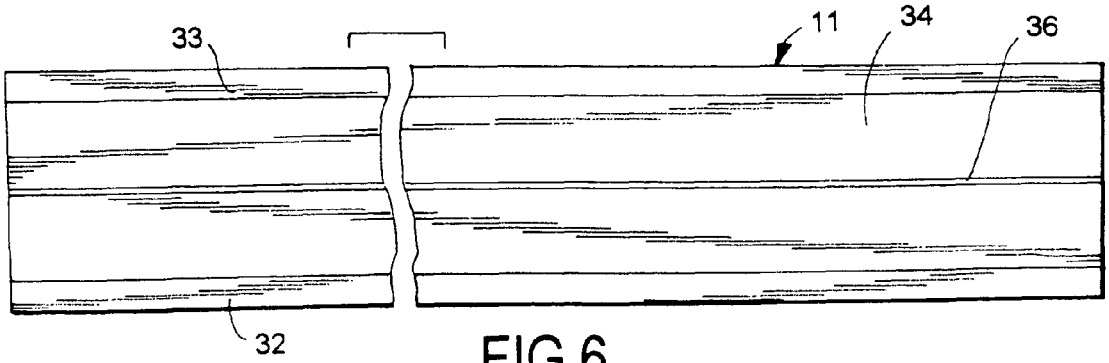
FIG. 6 is an enlarged foreshortened bottom plan view of the top rail of FIG. 1.

As shown in FIG. 3, rail 11 has opposite upright flat side walls 23 and 24 joined to a horizontal top wall 26. Top wall 26 has a longitudinal groove 27 extended along the center of wall 26. As shown in FIG. 5, groove 27 is located along the entire length of rail 11. The bottom of top wall 26 has a pair of laterally spaced longitudinal ribs 28 and 29. Ribs 28 and 29 project downwardly from the bottom of top wall 26 and extend the entire length of rail 11. The space or channel 31 between ribs 28 and 29 is vertically aligned with groove 27. Side walls 23 and 24 have inwardly turned lower end portions 32 and 33 located below a bottom wall 34 joined to side walls 23 and 24. As shown in FIG. 6, a longitudinal groove 36 extends longitudinally along the bottom of bottom wall 34. Returning to FIG. 3, a pair of upright longitudinal ribs 37 and 38 joined to the top of bottom wall 34 and are laterally spaced from each other to accommodate a fastener 42, shown as a screw. Ribs 28 and 29 are located in the vertical planes of ribs 37 and 38.

Figure 7:
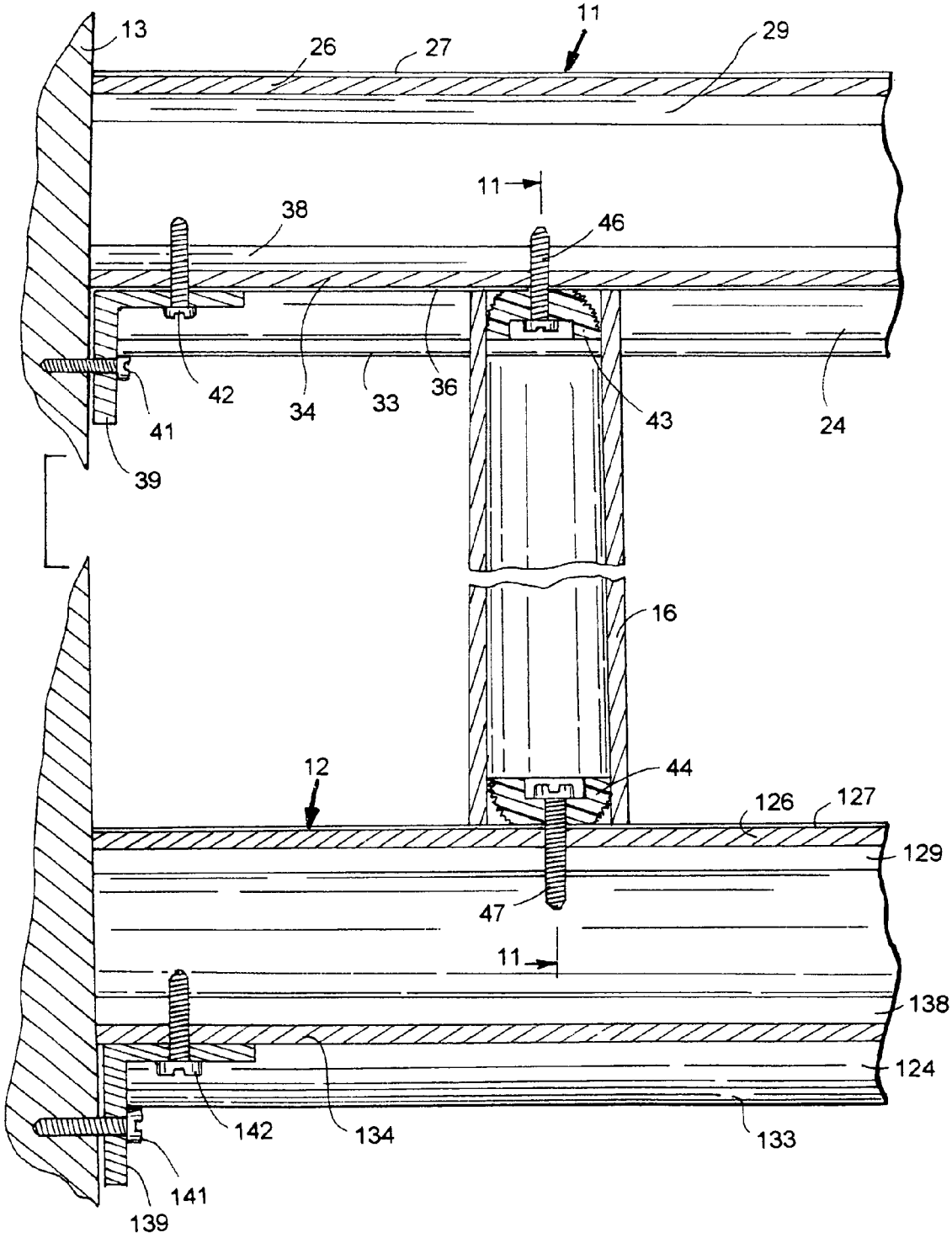
FIG. 7 is an enlarged sectional view taken along the line 7-7 of FIG. 2.

As shown in FIG. 7, fastener 42 attaches a right angle bracket 39 to bottom wall 34. A pair of fasteners can be used to secure bracket 39 to bottom wall 39. A second fastener 41, shown as a secure, secures bracket to post 13. A pair of fasteners can be used to secure bracket 39 to post 13. Bracket 39 is retained a small distance from post 13 by fastener 42 so that fastener 41 retains the end of rail 11 in firm contact with part 13. The opposite end of rail 11 is attached to post 14 with a bracket and fasteners identical to bracket 39 and fasteners 41 and 42. Bracket 39 has a width that fits between the rounded ends 32 and 33 of side walls 23 and 24. The opposite sides of bracket 39 are adjacent rounded ends 32 and 33 to inhibit twisting of bracket 39 relative to rail 11.

Lower rail 12 has the same structure as rail 11. The parts of rail 12 that correspond to rail 11 have the same reference numbers with the prefix 1. Bracket 139 is a right angle member attached with a first fastener 142 to rail 11 and second fastener 141 to post 13, as shown in FIG. 7. Two fasteners can be used to attach bracket to rail 12 and post 13. The opposite end of rail 12 is secured to post 14 with a bracket and fasteners identical to bracket 139 and fasteners 141 and 142.

Figure 11:
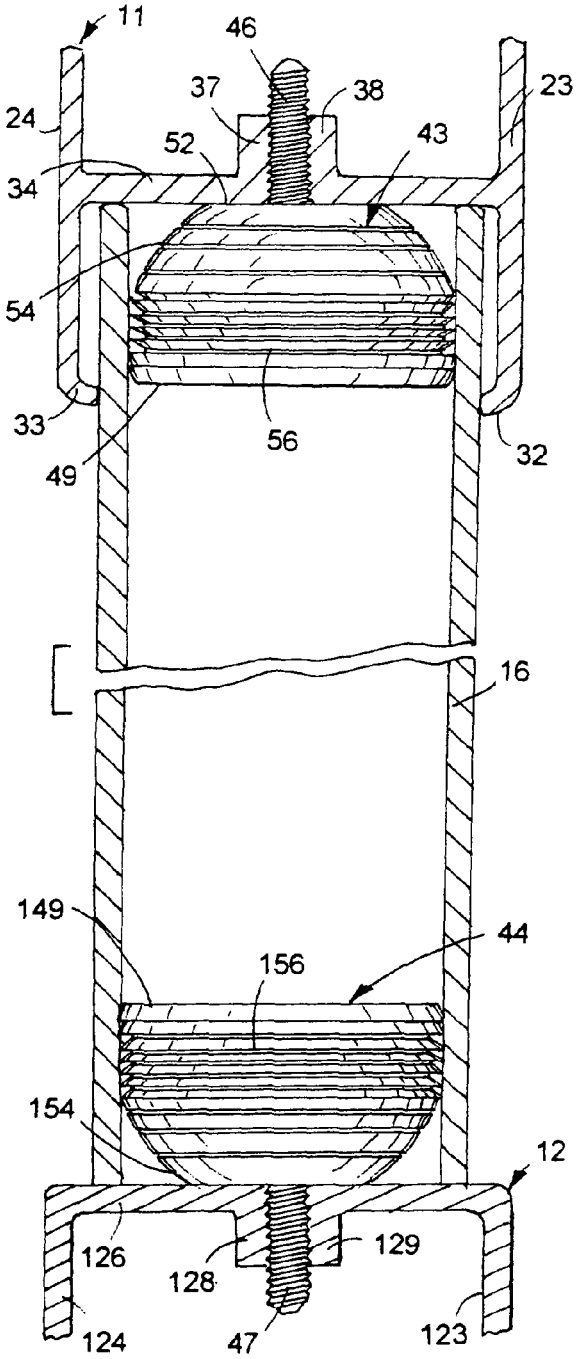
FIG. 11 is an enlarged foreshortened sectional view taken along line 11-11 of FIG. 7.

As shown in FIGS. 7 and 11, spindle 16 is retained on rails 11 and 12 with anchor balls 43 and 44. A fastener 46, shown as a screw, attaches an anchor ball 43 to the bottom wall 34 of rail 11. Fastener 46 is threaded through bottom wall 34 and ribs 37 and 38. Ribs 37 and 38 provide support for fastener 46. The groove 36 aligns fastener 46 with the space between ribs 37 and 38 during the assembly of ball knob 43 on rail 11. The upper end of spindle 16 telescopes over anchor ball 43 in an annular tight sealing fit relationship that holds the end of spindle on anchor ball 43 and against bottom wall 34 of rail 11. A fastener 47, shown as a screw in FIGS. 7 and 11, attaches an anchor ball 44 to the top wall 126 of bottom rail 12. Fastener 47 is threaded through top wall 126 and between ribs 128 and 129 thereby securing anchor ball 44 to rail 12. The lower end of spindle 16 telescopes over anchor ball 44 with an annular tight sealing fit relationship that holds the lower end of spindle 16 on anchor ball 44 and against top wall 126 of rail 12.

Figure 8:
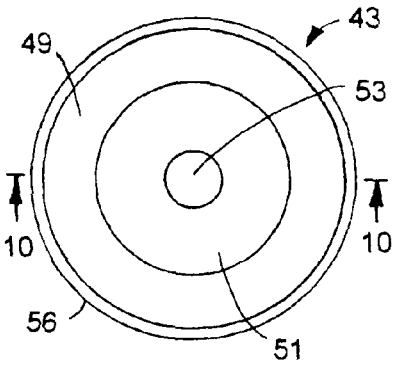
FIG. 8 is an enlarged to plan view of an anchor ball show in FIG. 7.
Figure 9:
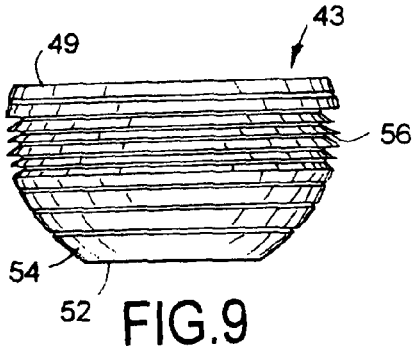
FIG. 9 is a side elevational view of the anchor ball shown in FIG. 8.
Figure 10:
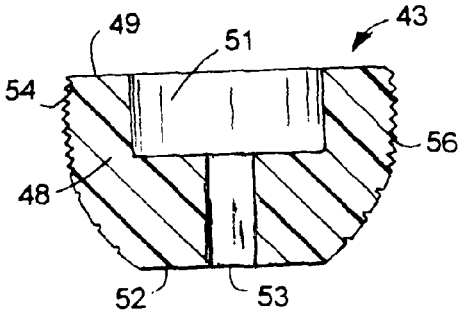
FIG. 10 is a sectional view taken along 10-10 of FIG. 8.

Anchor ball 43, shown in FIGS. 8 to 10, is a one-piece plastic member, such as high density polyethylene or Delrin, having a truncated spherical body 48 with an annular flat top wall 49. A cylindrical recess 52 is open to the top of body 48. The bottom of body 48 has a flat wall 52 that is parallel to top wall 49. A hole 53 extends between the bottom of recess 51 and bottom wall 52 to accommodate fastener 46. Hole 53 has a size to accommodate the shank of fastener with a close contact fit to eliminate lateral movement of anchor ball 43. Ball 48 has a convex shaped outside side wall 54 having a plurality of continuous circular ribs 56. The ribs 56 are arranged in concentric relationship around the entire side wall 54. The number of ribs 56 can vary. Each rib 56 has a downwardly and outwardly tapered top wall and a generally radial bottom wall. Ribs 56 have outer diameters greater than the inside diameters of the inside walls of the spindles 16-22. When spindle 16 is telescoped over anchor ball 43, a number of ribs 56 are deformed and biased into a tight annular elastic sealing engagement with the inside wall of spindle 16. The annular seating ribs 56 fix the location of the spindles on the anchor balls and prevent moisture, water, dust and dirt from entering into the inside of the spindles.

Anchor ball 44 mounted on top wall 126 of bottom rail 12 has the same structure as anchor ball 43. The parts of anchor ball 44 that correspond to anchor ball 43 have the same reference number with a prefix 1. The annular ribs 156 and anchor ball 44 are biased into annular tight sealing engagement when the bottom of spindle 16 is telescoped over anchor ball 44.

Figure 12:
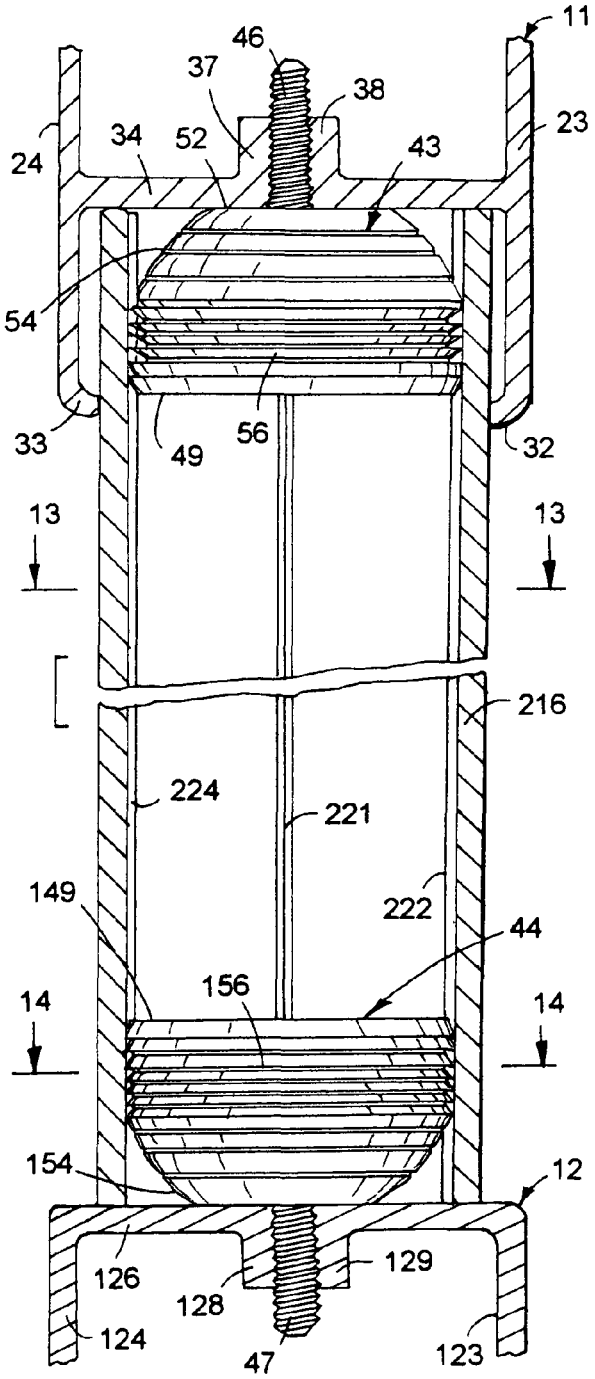
FIG. 12 is a foreshortened sectional view similar to FIG. 11 showing a square spindle extended between the top and bottom rails and mounted on anchor balls.
Figure 13:
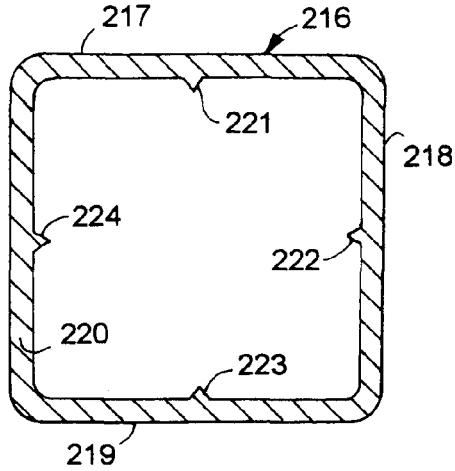
FIG. 13 is a sectional view taken along the line 13-13 of FIG. 12.
Figure 14:
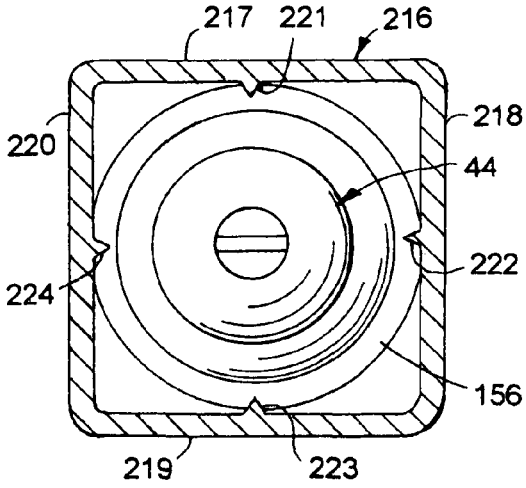
FIG. 14 is a sectional view taken along the line 14-14 of FIG. 12.

A modification of the spindle mounted on anchor balls 43 and 44 is shown in FIGS. 12 to 14. Spindle 216 is a linear metal member, such as an extruded aluminum tube having a square cross section. Spindle 216 has linear flat side walls 217, 218, 219 and 220 joined with rounded corners. The outside surfaces of side walls 217-220 are powder coated to provide a copper vein or black texture. The inside surfaces of side walls 217-220 have triangular ribs 221, 222, 223 and 224. The ribs 221-224 project inwardly and extend longitudinally along the middle of the inside surfaces of side walls 217-220.

As shown in FIG. 14, when spindle 216 is telescoped on anchor ball 44, ribs 221-224 embed into anchor ball ribs 156 preventing spindle 216 from turning relative to anchor ball 44. Ribs 58 are biased into tight fit engagement with the inside surfaces of spindle adjacent opposite sides of ribs 221-224 and hold the end of spindle 216 in engagement with the bottom wall 34 of rail 11. The upper end of spindle 216 telescopes over anchor ball 43. The ribs 221-224 embed into the outer portions or ribs 56 to prevent spindle 216 from turning relative to anchor ball 43.

In use, rails 11 and 12 are extruded in six foot lengths and powder coated with plastic or paint. Other sizes and lengths of rails can be used to construct a railing. The anchor balls 42 and 44 are pre-assembled on rails 11 and 12 with fasteners 46 and 47 prior to transport to a construction site. Rail 12 is secured to posts 13 and 14 with brackets 139 and fasteners 141 and 142, as shown in FIG. 7. Spindles 16-22 are then telescoped over anchor balls 44 on the top of rail 12. The top rail 11 is located between posts 13 and 14 above the upper ends of spindles 16-22. The top rail 11 and anchor balls 43 are moved downward to force anchor ball 43 into the top portion of spindles to seal the spindles around the anchor balls. Brackets 39 are secured to posts 13 and 14 to complete the railing.

While there has been shown and described preferred embodiments of the rail and railing, spindles and anchor balls of the invention, it is understood that changes in the size, shapes and arrangement of the structures, rails, spindles and anchor balls may be made by persons skilled in the art without departing from the invention.

The invention claimed is:

1. The combination of:

top and bottom rails, each rail comprising a one-piece metal member having upright side walls, a top wall joined to the side walls, said top wall having a top surface and a bottom surface, a longitudinal first groove located in the middle of the top surface, a pair of longitudinal first ribs joined to and extended downwardly from said bottom surface, said first ribs being laterally spaced from each other with a space between the first ribs being vertically aligned with the first groove, a bottom wall joined to the side walls below the top wall, said bottom wall having a top surface and a bottom surface, a longitudinal second groove located in the middle of the bottom surface of the bottom wall, a pair of longitudinal second ribs joined to and extended upwardly from said top surface of the bottom wall, said second ribs being laterally spaced from each other with a space between the second ribs being vertically aligned with the second groove, a plurality of first anchor balls mounted on the bottom rail along the length of the top wall of the bottom rail, first fasteners securing the first anchor balls to the top wall of the bottom rail, said first fasteners extended through the first groove, top wall and into the space between the pair of first ribs, said first fasteners being located in holding engagement with the first ribs to provide support for the first fasteners, a plurality of second anchor balls mounted on the top rail along the length of the bottom wall of the top rail, second fasteners securing the second anchor balls to the bottom wall of the top rail, said second fasteners extended through the second groove, bottom wall and into the space between the pair of second ribs, said second fasteners being located in holding engagement with the second ribs to provide support for the second fasteners, and a plurality of tubular members having opposite ends telescoped over the first and second anchor balls thereby connecting the tubular members to the top and bottom rails.

2. The combination of claim 1 wherein:

said side walls have lower end portions extended downwardly relative to the bottom wall.

3. The combination of claim 2 wherein:

the lower end portions of the side walls have inwardly curved ends.

4. The combination of claim 1 wherein:

the first and second ribs are located in substantially the same parallel spaced vertical planes.

5. The combination of claim 1 wherein:

the first and second grooves are located in substantially the same vertical plane.

6. The combination of claim 1 wherein:

the first and second ribs are located in substantially the same parallel spaced vertical planes and the first and second grooves are located in substantially the same vertical plane located between said parallel spaced vertical planes of the first and second ribs.

7. The combination of claim 1 wherein:

the first and second fasteners are screws located in threaded engagement with the first and second ribs.

8. The combination of claim 7 wherein:

each first and second anchor ball includes a generally spherical body having a top surface, a bottom surface, and an annular convex curved outside side wall, a plurality of laterally spaced and outwardly extended continuous annular ribs on the annular convex curved side wall of the body, said ribs extending completely around the annular convex curved side wall of the body and engageable with an end of the tubular member, a recess in the top surface of the body, and a hole in the body extended between the recess and the bottom surface accommodating fastener securing the anchor ball to the top wall of the rail.

9. The combination of claim 8 wherein:

said body and annular ribs are a one-piece plastic member.

10. A railing comprising:

upright laterally spaced posts;

a top rail extending between said posts;

first connectors securing the top rail to said posts;

a bottom rail located below the top rail and extended between said posts;

second connectors securing the bottom rail to said posts;

each of said top and bottom rails having top wall and a bottom wall, each top wall and bottom wall having a top surface and a bottom surface, a pair of longitudinal first ribs joined to and extended upwardly from the top surface of the bottom wall of the top rail, said first ribs being laterally spaced from each other with a first space between the ribs, a pair of longitudinal second ribs joined to and extended downwardly from the bottom surface of the top wall, said second ribs being laterally spaced from each other with a second space between said second ribs, a plurality of laterally spaced upright spindles extended between the bottom wall of the top rail and the top wall of the bottom rail, a plurality of first anchor balls mounted on the bottom wall of the top rail, first fasteners attaching the first anchor balls to the bottom wall of the top rail, said first fasteners extending through the bottom wall of the top rail into the first space between the first ribs and in holding engagement with said first ribs to provide support for the first fasteners, said spindles having upper end portions telescoped over the first anchor balls thereby connecting the spindles to the top rail, a plurality of second anchor balls mounted on the top wall of the bottom rail, second fasteners attaching the second anchor balls to the top wall of the bottom rail, said second fasteners extending through the top wall of the bottom rail into the second space between the second ribs and in holding engagement with said second ribs to provide support for the second fasteners, and said spindle having lower end portions telescoped over the second anchor balls thereby connecting the spindles to the top rail.

11. The railing of claim 10 wherein:

the first and second anchor balls each includes a generally spherical body having a top surface, a bottom surface, and an annular convex curved outside side wall, a plurality of outwardly extended ribs on the annular convex curved side wall of the body, and a hole in the body extended through the body for accommodating the fastener securing the anchor ball to the rail.

12. The railing of claim 11 wherein:

said body and ribs are a one-piece plastic member.

13. The railing of claim 10 wherein:

the top rail and bottom rail each have upright side walls joined to the top wall and bottom wall, and said side walls having lower end portions extended downwardly relative to the bottom wall.

14. The railing of claim 13 wherein:

the lower ends portions of the side walls have inwardly curved ends.

15. The railing of claim 10 wherein:

the first ribs and second ribs are located in substantially the same parallel spaced vertical planes.

16. The railing of claim 10 wherein:

the first and second fasteners are screws located in threaded engagement with the first and second ribs to provide support for the screws.

17. The railing of claim 10 wherein:

each of said top and bottom rails has a longitudinal groove in the top wall and bottom wall aligned with the space between the ribs on the top and bottom walls of the rails, and said fasteners extended through said grooves, walls and into spaces between said ribs.

* * * * *